US007417374B2

(12) United States Patent
Kim

(10) Patent No.: US 7,417,374 B2
(45) Date of Patent: Aug. 26, 2008

(54) PLASMA DISPLAY PANEL PROTECTIVE LAYER

(75) Inventor: Ki-Dong Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 290 days.

(21) Appl. No.: 10/969,345

(22) Filed: Oct. 19, 2004

(65) Prior Publication Data

US 2005/0134178 A1 Jun. 23, 2005

(30) Foreign Application Priority Data

Oct. 21, 2003 (KR) ..... 10-2003-0073520

(51) Int. Cl.
*H01J 17/49* (2006.01)

(52) U.S. Cl. ..... 313/587; 313/581; 313/582; 313/584

(58) Field of Classification Search ..... 313/587
See application file for complete search history.

(56) References Cited

U.S. PATENT DOCUMENTS 6,559,598 B2 * 5/2003 Mayr et al. ..... 313/587
6,828,588 B2 * 12/2004 Sakurai et al. ..... 257/79
6,955,840 B2 * 10/2005 Kim ..... 428/1.51
7,183,710 B2 * 2/2007 Ahn et al. ..... 313/587
2004/0027072 A1 * 2/2004 Inoue et al. ..... 313/586
2005/0077825 A1 * 4/2005 Creusot et al. ..... 313/587
2005/0212430 A1 * 9/2005 Ahn et al. ..... 313/587
2005/0264212 A1 * 12/2005 Kim ..... 313/587

FOREIGN PATENT DOCUMENTS

JP 11339665 A * 12/1999
KR 2000-0074172 12/2000
KR 2003-0050568 6/2003

OTHER PUBLICATIONS

English translation of JP 11-339665, Watabe et al.*

* cited by examiner

*Primary Examiner*—Sikha Roy
*Assistant Examiner*—Natalie K Walford
(74) *Attorney, Agent, or Firm*—Christie, Parker & Hale, LLP

(57) ABSTRACT

The plasma display panel includes a substrate, a plurality of electrodes formed on the substrate, a dielectric layer covering the plurality of electrodes, and a protective layer covering the dielectric layer. The protective layer comprises MgO with 0.1 to 3 mol % of $ZrO_2$ added.

5 Claims, 6 Drawing Sheets

PLASMA DISPLAY PANEL PROTECTIVE LAYER

CROSS-REFERENCE TO RELATED APPLICATIONS

This application claims priority to and the benefit of Korean Patent Application No. 10-2003-0073520 filed on Oct. 21, 2003 in the Korean Intellectual Property Office, the entire content of which is incorporated herein by reference.

BACKGROUND OF THE INVENTION (a) Field of the Invention

The present invention relates to a plasma display panel, and in particular, to a protective layer for a plasma display panel with improved performance characteristics.

(b) Description of Related Art

Generally, a plasma display panel (PDP) is a display device which displays characters or graphics. In operation, a predetermined voltage is applied across two electrodes placed within the discharge space of the plasma display panel with the resulting plasma discharge generating ultraviolet light. The ultraviolet light excites a phosphor film to generate visible light of a predetermined pattern, thereby displaying the desired images.

Plasma display panels are generally classified as an AC type, a DC type or a hybrid type. FIG. 10 is an exploded perspective view of a discharge cell of a common AC type plasma display panel. As shown in FIG. 10, the plasma display panel 100 includes a front (or rear) substrate 111, a plurality of address electrodes 115 formed on the bottom substrate 111, a dielectric layer 119 formed on the substrate 111 with the address electrodes 115, a plurality of barrier ribs 123 formed on the dielectric layer 119 to maintain the discharge distance while preventing the inter-cell cross talk, and a phosphor layer 125 formed on the barrier ribs 123.

A plurality of discharge sustain electrodes 117 are formed on a front substrate 113 facing the rear substrate 111 such that they are spaced apart from the address electrodes 115 by a predetermined distance while perpendicular thereto. A dielectric layer 121 and a protective layer 127 sequentially cover the discharge sustain electrodes 117. The protective layer 127 is typically formed from MgO, which is transparent such that visible light can pass through. It is known that such a MgO-based protective layer 127 can protect the dielectric layer 121 while maintaining excellent electron emission capacity. Recently, other materials have been also investigated for use in forming a protective layer 127.

The MgO protective layer is provided at a thickness of 3,000 to 7,000 Å and protects the dielectric layer from ion bombardment, and emits secondary electrons to lower the discharge voltage. The MgO protective layer is formed using various techniques such as sputtering, electron beam deposition, ion beam assisted deposition (IBAD), chemical vapor deposition (CVD), and sol-gel, and recently, the ion plating technique.

With the electron beam deposition technique, the electron beams accelerated by the electromagnetic fields collide against the MgO depositing material to heat and vaporize it, thereby forming a MgO protective layer. Compared to the electron beam deposition technique, the sputtering technique makes the resulting protective layer denser and provides improved crystal alignment, but involves high production costs. With the sol-gel technique, the MgO protective layer is formed with a liquid phase.

As an alternative to the various techniques of forming the MgO protective layer, the ion plating technique has been recently introduced with the steps of ionizing evaporated particles and forming a layer. The ion plating technique is similar to the sputtering technique in that it gives the properties of adherence and crystallinity to the resulting MgO protective layer, but differs from the latter in that it provides an advantage in making the deposition at high speed on the order of 8 nm/s.

The MgO material may be formed with a single crystalline phase or a sintered one. When the single crystalline MgO material is melted to make the deposition, it is difficult to control the concentration of dopants because the solid solution is limited by the cooling speeds. Therefore, the MgO protective layer is often formed by using the sintered MgO material where the relevant dopants are quantitatively added, based on the ion plating technique.

As the MgO protective layer contacts the discharge gas, the amount of MgO and its layer formation conditions may greatly influence the discharge characteristics and the performance characteristics of the MgO protective layer. Accordingly, it is desired to find an optimum material composition for the protective layer, which is well adapted for obtaining the desired performance characteristics.

SUMMARY OF THE INVENTION

The present invention improves the performance characteristics of a MgO protective layer for a plasma display panel.

In one embodiment of the present invention, an optimum material composition for a protective layer of a plasma display panel is provided. A plasma display panel including the improved material composition can have the following features.

The plasma display panel includes a substrate, a plurality of electrodes formed on the substrate, a dielectric layer covering the plurality of electrodes, and a protective layer covering the dielectric layer. The protective layer comprises MgO with 0.1 to 3 mol % of $ZrO_2$, and more preferably, 1.8 to 2.2 mol % of $ZrO_2$.

The $ZrO_2$ is preferably provided as a solid solution of Zr in MgO. Such a protective layer has a transmissivity of 90% or more, and a thickness of 600 nm or more. The protective layer has a refractive index of 1.45 to 1.74 while bearing a columnar crystal structure. The protective layer may be manufactured from a MgO pellet comprising MgO with 0.1 to 3 mol % of $ZrO_2$.

DETAILED DESCRIPTION OF PREFERRED EMBODIMENTS

An exemplary embodiment of the present invention will now be described in detail with reference to the accompanying drawings.

With a common plasma display panel, a protective layer covers the surface of a dielectric layer to protect it from the ion bombardment of the discharge gas during the discharging.

Figure 1:
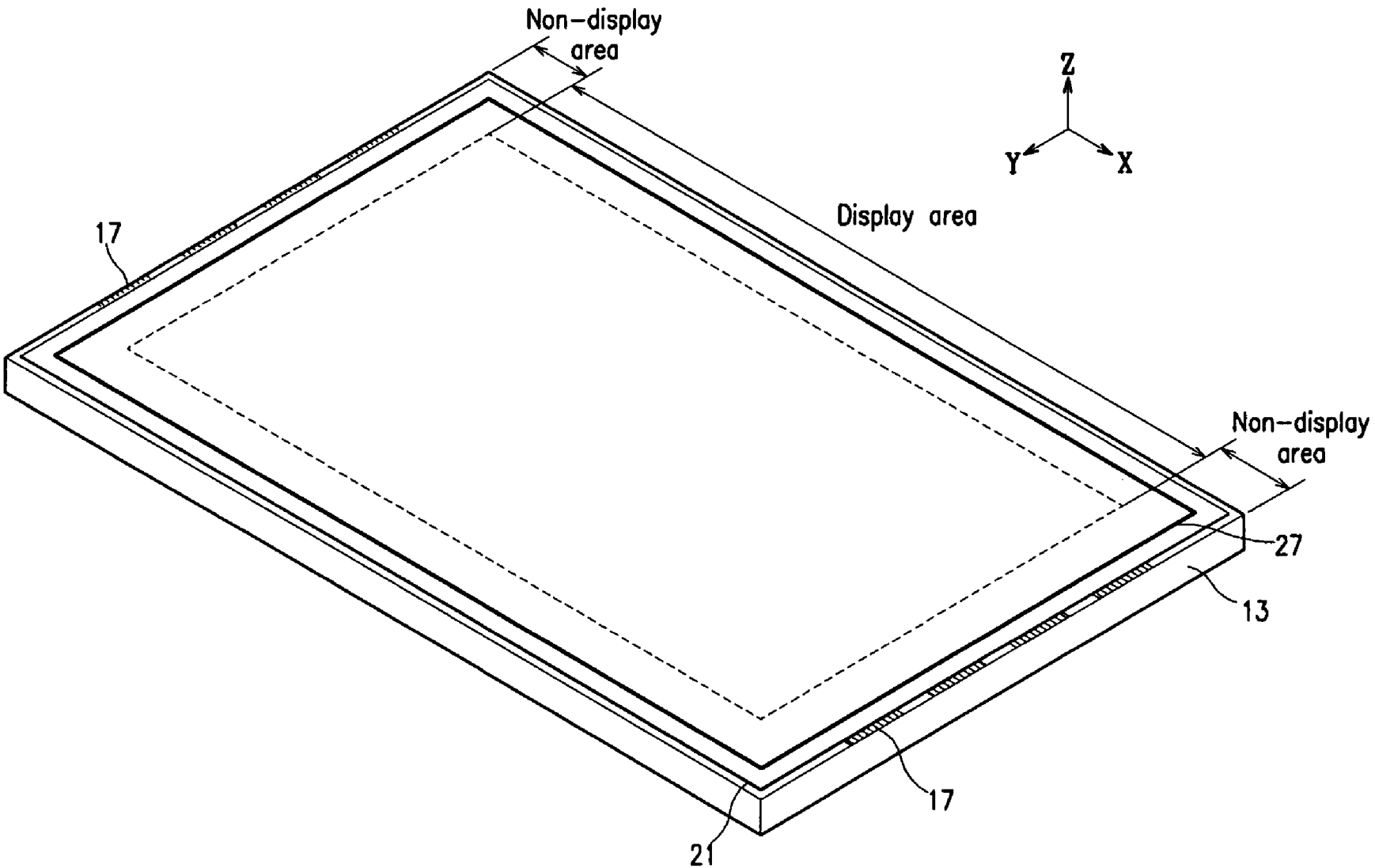
FIG. 1 is a perspective view of an front panel portion for a plasma display panel according to an embodiment of the present invention.

FIG. 1 is a perspective view of a plasma display panel according to an embodiment of the present invention. In the drawing, only the front panel portion of the plasma display panel according to the embodiment is separately illustrated.

As shown in FIG. 1, a plurality of first electrodes 17, a dielectric layer 21 and a protective layer 27 are sequentially formed on a substrate 13. Although not shown in FIG. 1, a plurality of second electrodes are formed on another substrate facing the substrate 13 while running perpendicular to the first electrodes 17, and a dielectric layer covers the second electrodes. Barrier ribs are formed on the dielectric layer, and phosphor films are formed between the barrier ribs. In this way, the rear panel portion of the plasma display panel is made.

The front and the rear panel portions of the plasma display panel are coated with a frit in their peripheries, and sealed to each other via the frit. A discharge gas such as Ne and Xe is injected into the inner space of the panel, thereby completing the plasma display panel.

With the plasma display panel according to an embodiment of the present invention, the address discharging is made among the electrodes by applying driving voltages to the electrodes from wall charges at the dielectric layer. With the discharge cells selected by the address discharging, the sustain discharge is made among the electrodes by AC signals alternately supplied to a pair of electrodes formed on the front panel portion. Accordingly, the discharge gas filled within the discharge space for forming the discharge cell is excited, thereby generating ultraviolet light. The ultraviolet light excites the phosphors to generate visible light, thereby displaying the desired images.

The protective layer is commonly formed with MgO because it has excellent sputtering-resisting characteristics, and a high secondary electron discharge coefficient.

The MgO protective layer is formed using the techniques such as sputtering, electron beam deposition, ion beam assisted deposition (IBAD), chemical vapor deposition (CVD), sol-gel, and recently, the ion plating technique.

The MgO material may be formed with a single-crystalline phase or a sintered one. However, when single-crystalline MgO material is melted to make a deposition, it is difficult to control the concentration of dopants as previously mentioned. Therefore, the MgO protective layer is preferably formed by using sintered MgO material where the relevant dopants are quantitatively added, based on the ion plating technique.

A pellet is formed and sintered to make the deposition of the MgO protective layer. As the decomposition speed of the pellet varies depending upon the size and form of the pellet, the size and form of the pellet can be used to control the speed of deposition of the protective layer. Therefore, various attempts have been made to optimize the size and form of the pellet.

As the MgO protective layer contacts the discharge gas, the contents and characteristics thereof greatly affect the discharge characteristic. The performance characteristics of the MgO protective layer largely depend upon the contents and the deposition conditions thereof.

It has been discovered that the properties of the protective layer can be improved when $ZrO_2$ is added to MgO that is used to form a protective layer for the plasma display panel. Such a layer can be formed from pellets in which MgO and $ZrO_2$ are mixed.

The $ZrO_2$ is added to MgO as a solid solution. The amount of $ZrO_2$ added can be up to 3 mol % at which point the solid solution limitation is reached. In order to achieve the desired characteristics, it is preferred that 0.1 mol % or more of $ZrO_2$ should be added.

Accordingly, the preferred amount of $ZrO_2$ is from 0.1 to 3 mol %, and more preferably, from 1.8 to 2.2 mol %.

When $ZrO_2$ is added to MgO, the deposition speed is reduced. This is because when the MgO—$ZrO_2$ layer is deposited, the vapor pressure of $ZrO_2$ is considerably lower than that of MgO. As the amount of addition of $ZrO_2$ is increased, the deposition speed of the MgO—$ZrO_2$ layer is further reduced.

Furthermore, when $ZrO_2$ is added to MgO, the X-ray diffraction peak is shifted to the lower value of $2\theta$ as the amount of $ZrO_2$ increases. This means that the lattice constant of the MgO—$ZrO_2$ layer is increased. This is because Zr has a large ion radius when solid-soluted in MgO. According to the X-ray diffraction peak, the addition of $ZrO_2$ does not adversely affect the crystallinity and alignment of the MgO layer.

The refractive index of the MgO—$ZrO_2$ protective layer increases as the amount of $ZrO_2$ is increased. This is because the refractive index of $ZrO_2$ is larger than that of MgO. For a MgO protective layer where the amount of $ZrO_2$ is from 0.1 to 3 mol %, the refractive index thereof is 1.45 to 1.74.

It has also been discovered that the packing density of a MgO—$ZrO_2$ protective layer is higher than that of a pure MgO layer. It is reported that as the packing density of the protective layer increases, the plasma corrosion resistant characteristic is enhanced. Therefore, in the case of a MgO—$ZrO_2$ protective layer, the plasma corrosion resistant properties are enhanced, and the resulting plasma display panel exhibits a longer life span.

It has also been discovered that where the surface roughness of the protective layer is high, the transmissivity of visible light is inhibited due to light scattering. Therefore, it is preferable to use a protective layer with a lower surface roughness.

When $ZrO_2$ is added to the MgO layer, the surface roughness thereof decreases until the amount of $ZrO_2$ added reaches 2 mol %, at which point the surface roughness increases. In the inventive MgO protective layer where the amount of addition of $ZrO_2$ is from 0.1 to 3 mol %, the surface roughness (RMS average value) thereof is 15 nm or less. That is, the inventive MgO—$ZrO_2$ layer has an excellent surface roughness.

It has still further been discovered that the inclusion of $ZrO_2$ greatly improves the optical properties. Therefore, even though $ZrO_2$ is added to the MgO layer, the transmissivity thereof varies little. Accordingly, in the case of the MgO protective layer where the amount of addition of $ZrO_2$ is from 0.1 to 3 mol %, the transmissivity thereof reaches 90% or more.

When $ZrO_2$ is added to the MgO layer, the secondary electron discharge coefficient thereof is increased compared to a pure MgO layer. For example, when the amount of addition of $ZrO_2$ is 2 mol %, the secondary electron discharge coefficient of the MgO—$ZrO_2$ protective layer is from 0.024 to 0.089 compared to that of a pure MgO layer being from 0.02 to 0.045. When the secondary electron discharge coefficient is increased, the discharge voltage is decreased, thereby enhancing the device driving and discharging characteristics at lower voltages.

It has further been discovered that when $ZrO_2$ is added to the MgO layer, the discharge initiating voltage (Vf) and the discharge sustain voltage (Vs) are reduced compared to the pure MgO layer. For example, the pure MgO layer involves the discharge initiating voltage of 187 V and the discharge sustain voltage of 155 V, whereas when 2 mol % of $ZrO_2$ is added to the MgO layer, the discharge initiating voltage thereof is 167 V, and the discharge sustain voltage is 137 V. That is, the voltage characteristic of the protective layer is enhanced by the addition of $ZrO_2$.

When $ZrO_2$ is added to the MgO layer, the performance characteristics of the protective layer are also enhanced. Furthermore, when the MgO—$ZrO_2$ layer is heat-treated, the moisture-resistance is improved, thereby further enhancing the layer's properties. While the specific temperature, time and pressure for the heat treatment step are not essential, it is preferable that the heat treatment be carried out under vacuum at 100° C. or more for 20 or more minutes.

When the MgO—$ZrO_2$ solution has undergone heat treatment, the secondary electron discharge coefficient of the MgO—$ZrO_2$ protective layer is increased, but the discharge initiating voltage and the discharge sustain voltage thereof are decreased.

The inventive MgO—$ZrO_2$ protective layer is formed with a thickness of 600 nm or more. When the protective layer has a columnar crystal structure grown in mixed directions, better capacity enhancement effect can be obtained.

EXAMPLE 1

A liquid phase reaction technique (LPE) was used while taking $Mg(OH)_2$ and $ZrOCl_2.8H_2O$ as a starting material. The mixture was weighed such that the amount of addition of $ZrO_2$ was 0, 1, 2, 3 and 4 mol %. The mixture was then mixed with distilled water to a concentration of 40% and ball-milled by a zirconia ball to make a slurry.

The slurry was spray-dried, and heat-treated at 1000° C. for one hour. It was then ball-milled under wet conditions by a zirconia ball of 10 mm for 12 hours.

Thereafter, the target material was again spray-dried, and uni-directionally compressed with a pressure of 2000 Pa at ambient temperature to form a pellet with a diameter of 5 mm. The pellet was sintered at 1600° C. for one hour. The sintered pellet was used as a starting material for the electron beam deposition.

Electron beam deposition equipment with an electron gun with a maximum output of 3 kW was used to deposit a MgO—$ZrO_2$ layer according to the invention. The voltage applied thereto was fixed to 4 kW. A MgO—$ZrO_2$ protective layer was deposited while varying the application current from 100 mA to 500 mA in consideration of the passage difference between the electron gun and the pellet. The deposition speed and the surface roughness of the target layer were analyzed, and the current was then fixed to 250 mA. The chamber of the electron beam deposition equipment was kept in a vacuum at between 10 and 6 Torr, and the MgO—$ZrO_2$ protective layer was deposited onto the respective pellets where the amount of addition of $ZrO_2$ was 0, 1, 2, 3 and 4 mol %, respectively.

The performance characteristics were evaluated with respect to the deposited MgO—$ZrO_2$ protective layer.

Figure 2:
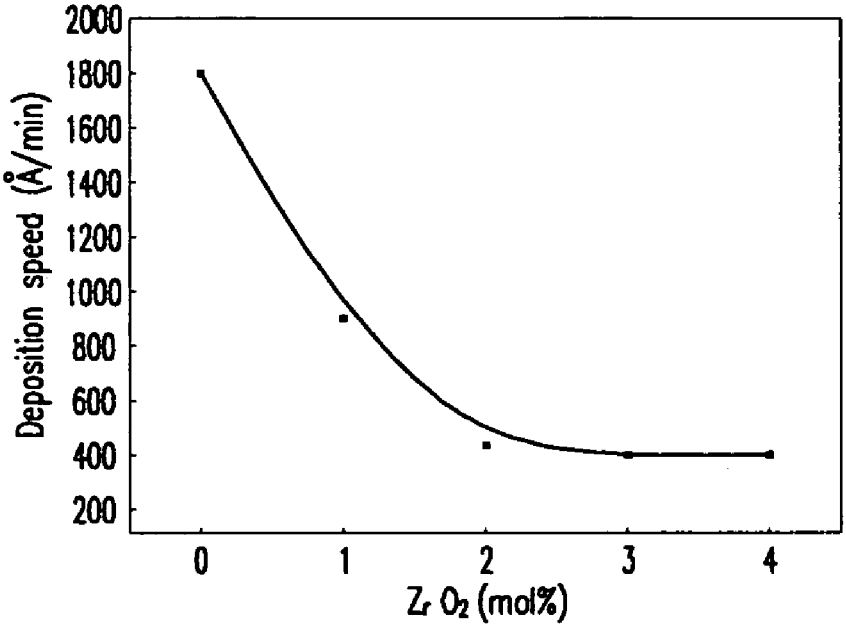
FIG. 2 is a graph illustrating the deposition speed of a MgO—$ZrO_2$ protective layer as a function of the amount of addition of $ZrO_2$.

FIG. 2 is a graph illustrating the deposition speed of the MgO—$ZrO_2$ protective layer as a function of the amount of addition of $ZrO_2$. As illustrated in the graph, it was confirmed that the deposition speed of the protective layer was decreased with the addition of $ZrO_2$. It is believed that the deposition speed was reduced because the vapor pressure of $ZrO_2$ is significantly lower than that of MgO.

However, when the amount of addition of $ZrO_2$ exceeds 3 mol %, Zr goes over the solid solution limit, and no longer forms a solid solution with MgO. At such levels, a reduction in the deposition speed is no longer achieved. Accordingly, it is preferable that the amount of addition of $ZrO_2$ is 3 mol % or less due to the solid solution limit thereof.

Figure 3:
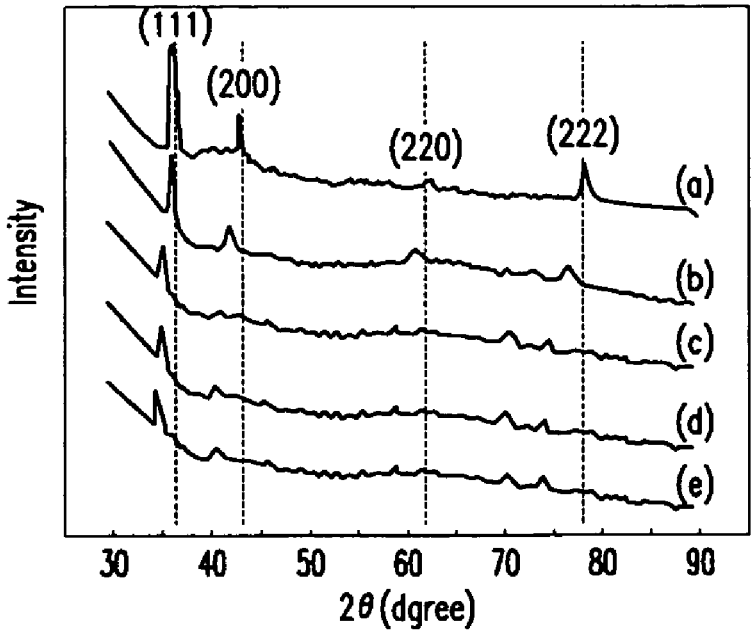
FIG. 3 illustrates the X-ray diffraction analysis result of a MgO—$ZrO_2$ protective layer.

FIG. 3 illustrates the X-ray diffraction analysis of a MgO—$ZrO_2$ protective layer, where (a) to (e) indicate the cases where the amount of addition of $ZrO_2$ was 0, 1, 2, 3 and 4 mol %, respectively.

With the X-ray diffraction analysis, Cu—Kα was used as a target, and Ni was used as a filter. The measurement was made at a speed of 2° per minute.

As shown in FIG. 3, as the amount of addition of $ZrO_2$ increased, the X-ray diffraction peak was shifted to the low value of 2Θ. This means that Zr with a large ion radius is solid-soluted in MgO, and the lattice constant of the MgO—$ZrO_2$ layer is increased.

However, where the amount of $ZrO_2$ exceeds 3 mol % (the peak at (d)), any shift in the peak was not observed because the Zr was over the solid solution limit.

Meanwhile, it was confirmed from the X-ray diffraction peak that when $ZrO_2$ was added, no problems in the crystallinity and alignment of the MgO—$ZrO_2$ protective layer were observed.

Figure 4:
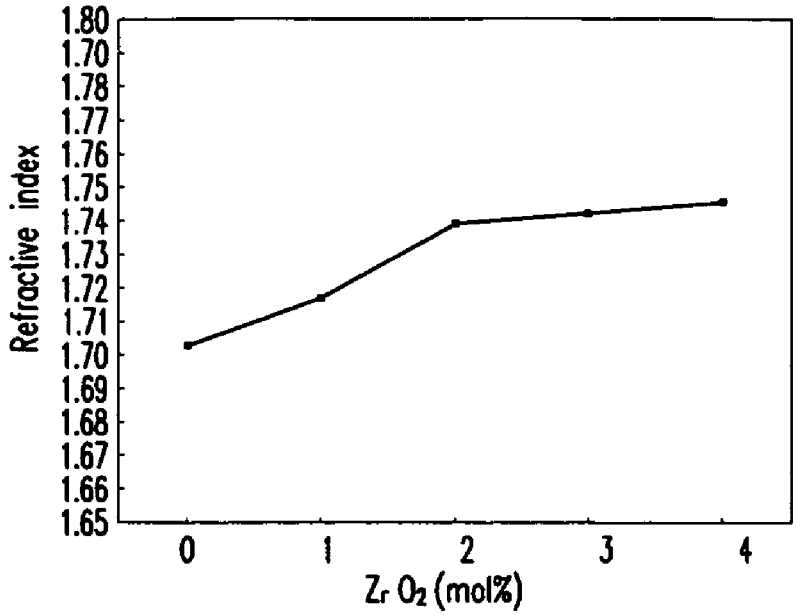
FIG. 4 is a graph illustrating the refractive index of a MgO—$ZrO_2$ protective layer as a function of the amount of addition of $ZrO_2$.

FIG. 4 is a graph illustrating the refractive index of the MgO—$ZrO_2$ protective layer as a function of the amount of addition of $ZrO_2$. As illustrated in the graph, the refractive index of the target layer increased as the amount of addition of $ZrO_2$ increased. Where the MgO protective layer includes $ZrO_2$ in an amount from 0.1 to 3 mol %, it was confirmed that the refractive index thereof was 1.74 or less.

Figure 5:
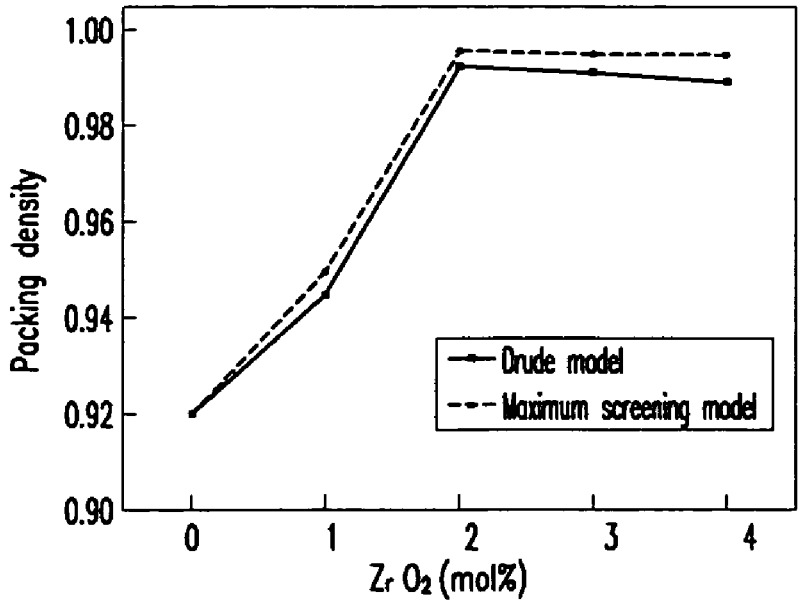
FIG. 5 illustrates the packing density of a MgO—$ZrO_2$ protective layer as a function of the amount of addition of $ZrO_2$.

FIG. 5 illustrates the packing density of the MgO—$ZrO_2$ protective layer as a function of the amount of $ZrO_2$ added. The packing density was measured from the Drude model and the maximum screening model.

As shown in FIG. 5, with the Drude model and the maximum screening model, it was confirmed that the packing density of the MgO—$ZrO_2$ protective layer was higher than that of a pure MgO layer. Accordingly, for a MgO protective layer with $ZrO_2$ added, the plasma corrosion resistant characteristic is enhanced, and the life span of the plasma display panel is lengthened.

Figure 6:
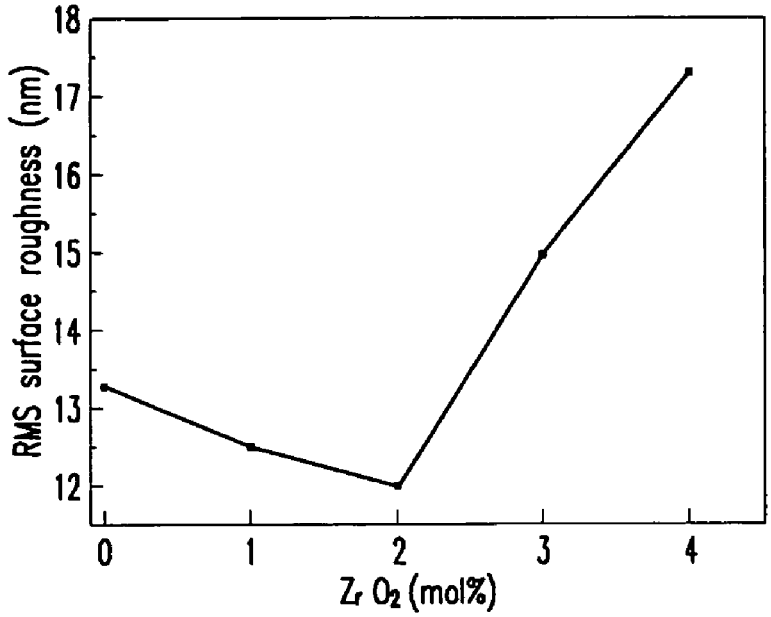
FIG. 6 is a graph illustrating the surface roughness of a MgO—$ZrO_2$ protective layer as a function of the amount of addition of $ZrO_2$.

FIG. 6 is a graph illustrating the surface roughness of the MgO—$ZrO_2$ protective layer as a function of the amount of $ZrO_2$ added. The surface roughness was measured with different samples having the same composition five times, with no significant deviation. Therefore, only the mean value of the surface roughness (RMS) was indicated.

As shown in FIG. 6, the surface roughness was decreased till the amount of addition of $ZrO_2$ reached 2 mol %, and then, increased. Where the MgO protective layer included $ZrO_2$ from 0.1 to 3 mol %, the surface roughness thereof (the RMS mean value) was 15 nm or less, and more specifically, the surface roughness is from 12 to 15 nm. That is, the inventive MgO—$ZrO_2$ layer has an excellent surface roughness.

The transmissivity was measured using an ellipsometer (Plas Mos SD2302, German) and an ultraviolet light/visible light spectrometer. A transmissivity of 90% or more was confirmed for all cases.

Figure 7:
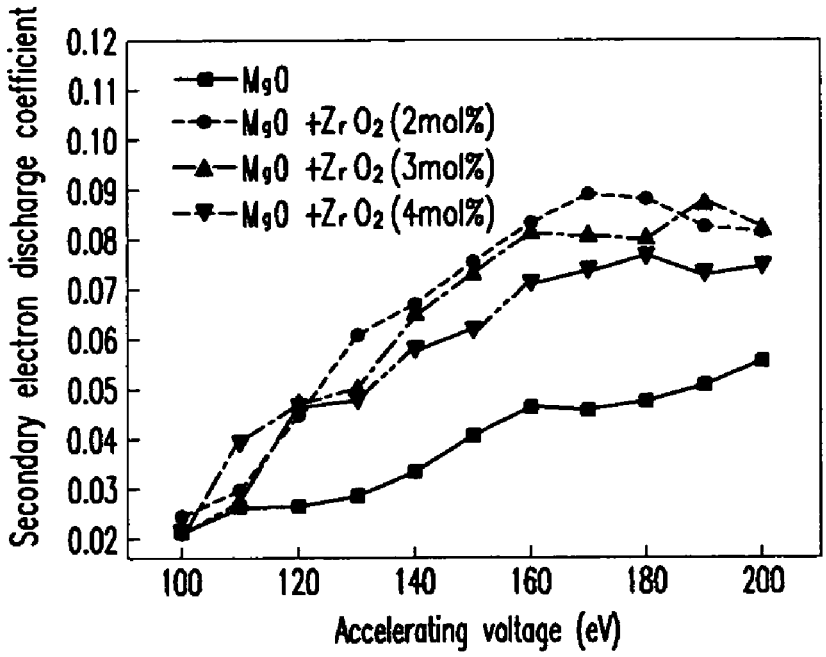
FIG. 7 illustrates the secondary electron discharge coefficient as a function of the accelerating voltage per the amount of addition of $ZrO_2$.

FIG. 7 illustrates the secondary electron discharge coefficient as a function of the accelerating voltage based on the amount of $ZrO_2$ added. The accelerating voltage was 100 to 200 V, and Ne gas was used.

As shown in FIG. 7, the secondary electron discharge coefficient of the MgO—$ZrO_2$ protective layer was higher than that of a pure MgO layer. Particularly when the amount of addition of $ZrO_2$ was 2 mol %, the secondary electron discharge coefficient of the MgO—$ZrO_2$ protective layer was 0.024 to 0.089, which is about twice as efficient as that of pure MgO which was 0.02 to 0.045. That is, when the secondary electron discharge coefficient of the MgO—$ZrO_2$ protective layer is increased, the discharge voltage is decreased, thereby serving to enhance the driving and discharging characteristics at lower voltages.

Figure 8:
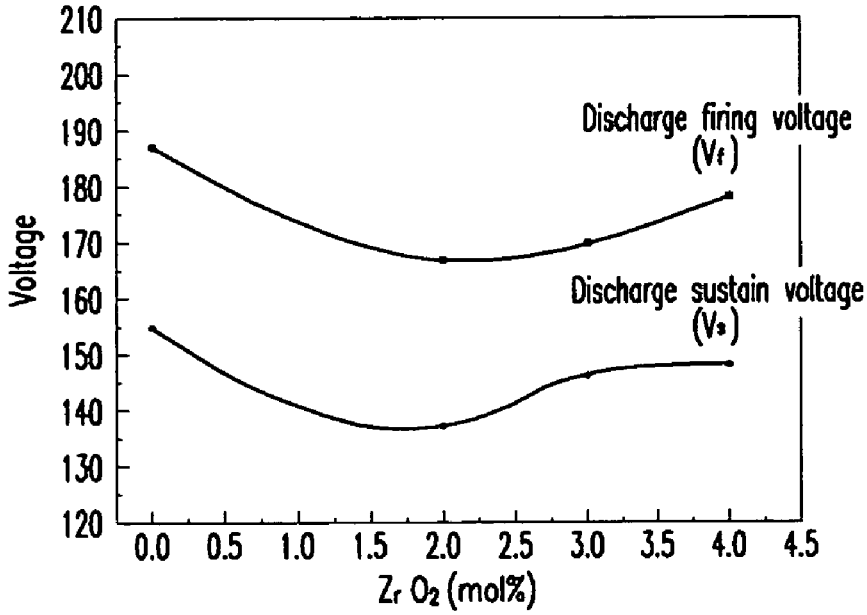
FIG. 8 illustrates the discharge initiating voltage Vf and the discharge sustain voltage Vs of a MgO—$ZrO_2$ protective layer as a function of the amount of addition of $ZrO_2$.

FIG. 8 illustrates the discharge firing voltage (Vf) and the discharge sustain voltage (Vs) of the MgO—$ZrO_2$ protective layer as a function of the amount of addition of $ZrO_2$. As shown in FIG. 8, the discharge firing voltage and the discharge sustain voltage of the MgO—$ZrO_2$ protective layer were reduced, compared to the pure MgO layer. Particularly when the amount of $ZrO_2$ added was 1.8 to 2.2 mol %, the discharge initiating voltage and the discharge sustain voltage of the MgO—$ZrO_2$ protective layer were at the lower level, and the best discharge characteristics were obtained.

Furthermore, in order to improve the moisture-resistance of the protective layer, a MgO—$ZrO_2$ layer including 2 mol % $ZrO_2$ was vacuum heat-treated at 150° C. for 30 minutes, and the secondary electron discharge coefficient was measured, followed by comparing the measurement result with that of the non-treated sample.

Figure 9:
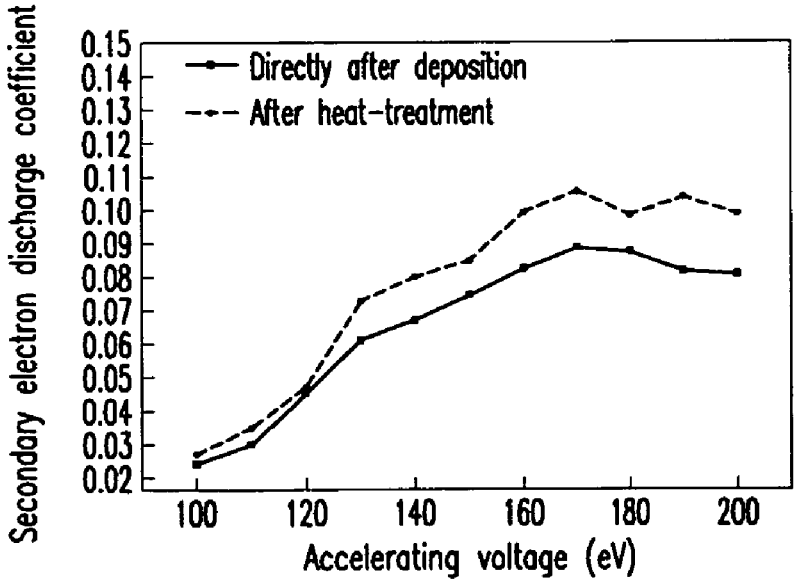
FIG. 9 illustrates the secondary electron discharge coefficient of the non-treated MgO—$ZrO_2$ protective layer (the amount of addition of $ZrO_2$: 2 mol %) directly after the deposition and that of the heat-treated MgO—$ZrO_2$ protective layer (the amount of addition of $ZrO_2$: 2 mol %).
Figure 10:
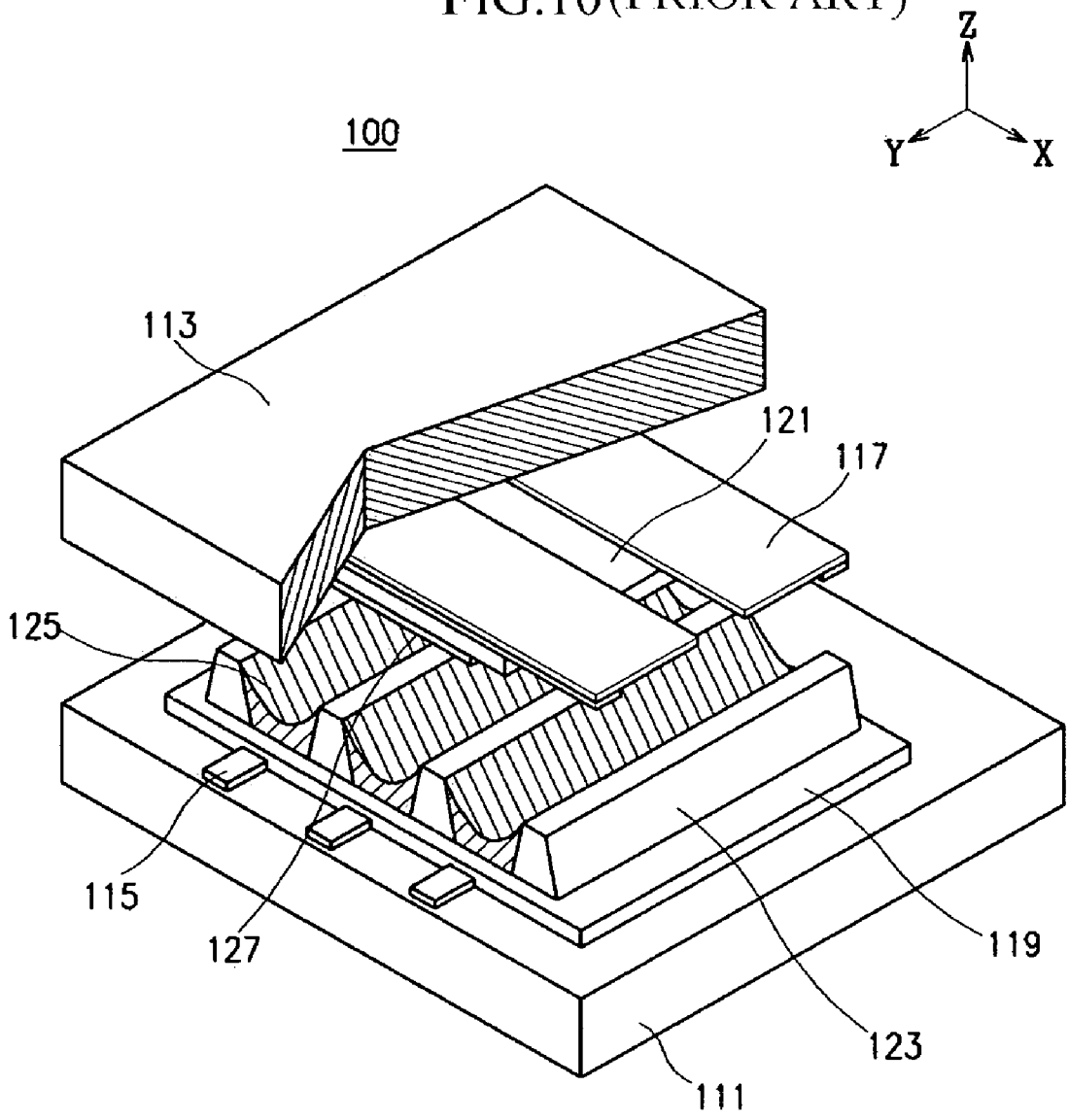
FIG.10(PRIOR ART)
FIG. 10 is an exploded perspective view of a discharge cell of a common AC type plasma display panel.

FIG. 9 illustrates the secondary electron discharge coefficient of the non-treated MgO—$ZrO_2$ protective layer with 2 mol % $ZrO_2$ directly after the deposition and that of the heat-treated MgO—$ZrO_2$ protective layer with 2 mol % $ZrO_2$ as a function of the accelerating voltage.

As shown in FIG. 9, when heat-treated, the secondary electron discharge coefficient of the MgO—$ZrO_2$ protective layer increased.

As described above, when a protective layer where MgO includes 0.1 to 2.2 mol % $ZrO_2$, the electron emission capacity was improved, as was the display quality of the plasma display panel.

Although preferred embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. A plasma display panel comprising:

a substrate;

a plurality of electrodes formed on the substrate;

a dielectric layer covering the plurality of electrodes; and a protective layer covering the dielectric layers, the protective layer comprising MgO and 1.8 to 2.2 mol % $ZrO_2$, wherein the protective layer has a transmissivity of 90% or more, the protective layer having a surface roughness ranging from 12 to 15 nm.

2. The plasma display panel of claim 1 wherein the protective layer comprises a solid solution of $ZrO_2$ in MgO.

3. The plasma display panel of claim 1 wherein the protective layer has a thickness of 600 nm or more.

4. The plasma display panel of claim 1 wherein the protective layer has a columnar crystal structure.

5. The plasma display panel of claim 1, wherein the protective layer has a refractive index ranging from 1.45 to 1.74.

* * * * *